United States Patent [19]

Walters

[11] Patent Number: 4,635,682

[45] Date of Patent: Jan. 13, 1987

[54] HYDRAULIC VALVES WITH DUAL FEEDBACK CONTROL

[75] Inventor: Ronald B. Walters, Wembley, England

[73] Assignee: Vickers, Incorporated, Troy, Mich.

[21] Appl. No.: 710,956

[22] Filed: Mar. 14, 1985

Related U.S. Application Data

[63] Continuation of Ser. No. 508,618, Jun. 28, 1983, abandoned.

[30] Foreign Application Priority Data

Jul. 2, 1982 [GB] United Kingdom ..... 8219280

[51] Int. Cl.[4] ..... F15B 11/02

[52] U.S. Cl. ..... 137/625.64; 137/625.63

[58] Field of Search ..... 137/625.64, 625.63, 137/486, 487.5

[56] References Cited

U.S. PATENT DOCUMENTS

| | | | |
|---|---|---|---|
| 2,929,362 | 3/1960 | Hayner | 137/625.63 |
| 3,699,989 | 10/1972 | O'Connor et al. | 137/487.5 |
| 3,752,189 | 8/1973 | Marr et al. | 137/625.65 |
| 3,874,269 | 4/1975 | Walters | 137/625.63 |
| 4,031,813 | 6/1977 | Walters et al. | 137/625.64 |
| 4,164,167 | 8/1979 | Imai et al. | 91/433 |
| 4,266,572 | 5/1981 | Schuttenberg et al. | 137/625.63 |
| 4,335,867 | 6/1982 | Bihlmaier | 137/625.63 |
| 4,381,699 | 5/1983 | Haussler | 137/487.5 |
| 4,456,031 | 6/1984 | Taplin | 137/625.64 |

FOREIGN PATENT DOCUMENTS

| | | | |
|---|---|---|---|
| 2523600 | 12/1976 | Fed. Rep. of Germany | 137/625.64 |
| 48004 | 4/1980 | Fed. Rep. of Germany | 137/625.64 |

*Primary Examiner*—Robert E. Garrett
*Assistant Examiner*—John Kwon
*Attorney, Agent, or Firm*—Barnes, Kisselle, Raisch, Choate, Whittemore & Hulbert

[57] ABSTRACT

In a hydraulic valve with flow feedback there is provided a position sensor (13) to sense the position of the flow-controlling valve member and provide a position feedback signal. The flow and position feedback signals are compared and a switching circuit (143) selects whichever of the signals indicates the larger flow.

8 Claims, 2 Drawing Figures

HYDRAULIC VALVES WITH DUAL FEEDBACK CONTROL

Figure 1:
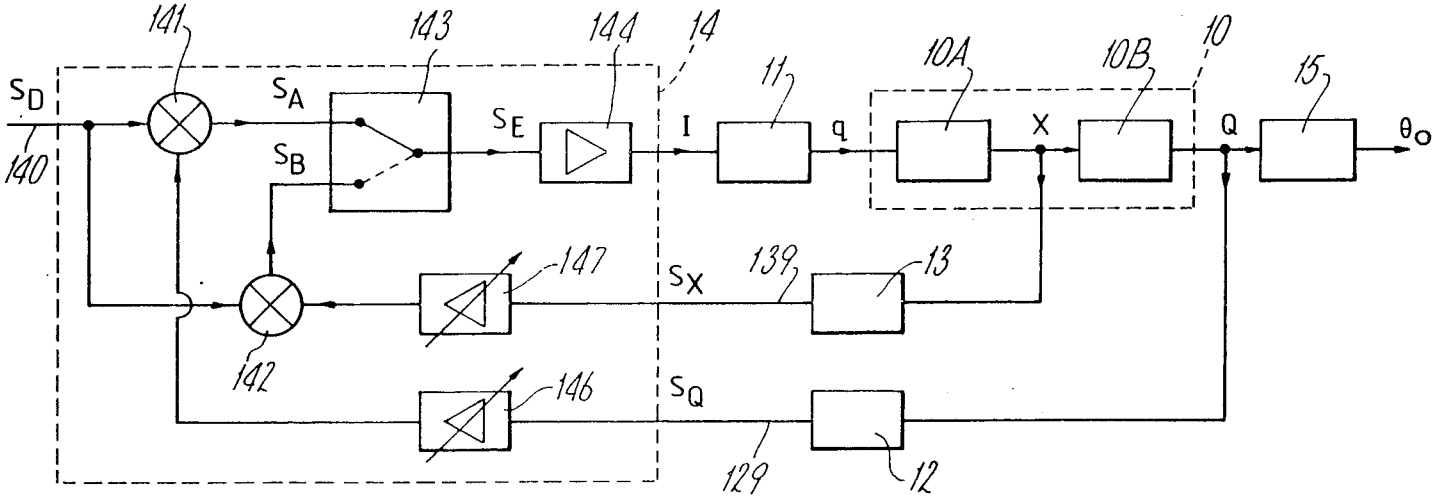

This application is a continuation of application Ser. No. 508,618 filed June 28, 1983, now abandoned.

This invention relates to feedback controlled hydraulic valves and feedback control arrangements for hydraulic valves.

Hydraulic control valves with flow feedback control are known, for example from British Patent Specification No. 1,335,042 which discloses a valve comprising a main valve, a pilot valve to operate the main valve, an electric force motor to set the pilot valve, and a flow sensing arrangement to generate and supply to the pilot valve a feedback pressure differential proportional to the rate of fluid flow through the main valve. The main valve and the pilot valve are both spool valves, with the setting of the pilot valve spool determining the relative magnitudes of two opposing control pressures applied across the main valve spool and hence the main valve spool setting. The pilot valve setting is determined by the resultant of the force applied to the pilot spool by the force motor, and the force due to the feedback pressure differential which is applied across the pilot spool. The feedback pressure differential is generated in the flow sensor which is, broadly speaking, a continuously variable orifice bounded by the periphery of a spring-loaded movable element and the adjacent internal wall of a throated fluid passage within which the movable element is located and which widens down stream from its region of narrowest cross-section. The spring-loaded element is urged in a down stream direction by the pressure differential generated as a result of fluid flowing through the flow restriction, and in an upstream direction by the restoring force of the spring which urges the element towards the region of narrowest cross-section. For each rate of fluid flow there is an equilibrium position in which the size of the variable orifice is such that the generated pressure differential exactly balance the restoring force of the spring.

Using the feedback differential itself as a feedback signal in a manner similar to that described in the British Patent Specification No. 1,335,042 is one option. Another option is to derive an equivalent electrical feedback signal, as disclosed in British Patent Specification No. 1,462,879. The electrical feedback signal may be derived either by converting the pressure differential into an electrical signal by means of a mechanical-to-electrical pressure transducer, or by measuring electrically the amount of displacement of the movable flow sensor element. For the sake of brevity, feedback of the pressure differential or of an electrical signal derived from it will be referred to hereinafter as pressure feedback and feedback of an electrical signal derived from measuring the displacement of the movable flow sensor element as displacement feedbacks.

Drawbacks of these and similar flow feedback systems become apparent if the implications of flow feedback failure are analysed.

From a consideration of the physical construction of the flow sensor itself, it can be seen that potential failure modes of the flow sensor may be divided into two basic types. The first mode consists of the movable element becoming stuck in or near the narrowest region of the throat, and the second mode, which may be caused by failure of the return spring, of substantiaily unopposed movement into, and possible sticking of the movable element in or near, the widest region of the throat.

Other forms of flow feedback failure, for example the absence of an electrical feedback signal on account of a break in the electrical connection, can be classed as corresponding to one of these two failure modes.

Irrespective of the type of flow feedback failure which occurs, the result is an incorrect feedback signal and consequential impairment or loss of control. Depending on the kind of flow feedback, i.e. pressure or displacement feedback, the result may be a closing of the valve, an opening of the valve, or osciilation of the valve between the closed and the open states.

Taking as the first example a valve arrangement employing pressure feedback, in the case of the first of the afore-mentioned failure modes the orifice of the flow sensor will, over substantiaily the whole of the flow range, be smaller than the orifice produced by correct operation of the flow sensor. Consequently, the pressure differential for any given flow will be higher than should be. This appears to the valve as higher than the set flow rate, and the feedback mechanism operates to close the valve until the pressure drop is equal to that which would have been generated at the set flow, had the flow sensor operated correctly. Thus the valve will close to give a lower flow rate.

In contrast, in the second failure mode, in which the displacement of the movable element is substantially unopposed, the flow sensor orifice is, at least over most of the flow range, going to be larger than appropriate for the extant flow rate. The pressure differential resulting from a given flow rate is therefore below the correct value. This is seen by the valve as indicating insufficiently high flow, with the effect that flow is increased by further opening the main valve.

In the case of displacement feedback, the situation is somewhat different in that the arrest of the flow sensor in any position will result in the vaive closing if the set flow is lower, and in the valve opening fully if the set flow is higher, than the flow rate indicated by the position taken up by the flow sensing element. In circumstances in which a weak remanent restoring force acts on a freely moving flow sensing element, continued oscillation or hunting of the main valve between open and closed states may be induced.

While flow sensor failure which results merely in closure of the valve will in many cases be found acceptable, any flow sensor failure which results in excessive flow, or oscillation of the valve, is considered unacceptable in most applications, especially when the nature of the load is such that damage or injury may be caused by excess flow or sudden surges in the flow to the load.

The present invention aims to overcome, or at least mitigate, some of the effects of flow feedback failure and, in particular, the effects of flow feedback failure of the kind leading to excessive flow, to valve oscillations or to loss of control.

According to the present invention, in a valve arrangement with flow feedback there are provided means to sense the position of the flow controlling valve member, and means to override the flow feedback if at any set flow a corresponding predetermined valve opening, as determined by the positioning of the valve member, does not result in a flow feedback signal indicating a sufficiently large flow.

In order to appreciate the operation of the present invention it must be remembered that for a given valve setting the flow through the valve will be the lower the higher the encountered load resistance or, put differently, the main valve opening required to obtain a desired flow to the load must be the greater, the greater the encountered load resistance. The present invention only allows the valve to open, for each desired flow rate, at most by a predetermined amount which corresponds to a maximum premissible load resistance.

Conveniently, the positioning of the valve member is sensed electrically such as by variable resistance or inductive devices, for example.

If flow feedback is via an electrical feedback signal, a comparator and switching circuit may be provided to compare the flow feedback signal with the positioning signal, and to switch control of the valve to whichever signal corresponds to the lower flow.

Alternatively, in a valve such as, for example, that of British Patent Specification No. 1,335,042, which has purely hydraulic flow feedback, positioning of the main stage flow control element may be measured electrically. The electrical signal so generated may then operate to reset the pilot stage to neutral, so preventing further movement of the valve member, in the event that the main valve has reached the predetermined opening.

Further advantages are afforded by the present invention. Firstly, operation of a valve arrangement incorporating the invention is improved under conditions in which a load requires the application of a much larger force to set it in motion than is necessary for maintaining its motion. Under these circumstances, the effect of the flow feedback arrangement alone would be to indicate absence of flow until the load begins to move, with the result that the valve continues opening until the load starts moving. At this point, however, the valve opening may substantially exceed the valve opening necessary during the subsequent movement of the load. The effect of this on the load will frequently be an initial jerk and, once the resistance to motion has been overcome, excessively fast movement until flow feedback has restored, i.e. reduced, the flow to the correct flow rate. By preventing opening of the valve beyond a predetermined position, the present invention keeps any initial jerk within limits, and reduces both the excess velocity of the subsequent movement and the time taken to restore the correct flow.

A further advantage accrues from the generally shorter response time of position sensing as compared to flow sensing. On account of the delay inherent in flow feedback, there is a tendency for the valve to over-shoot on rapid upward changes in the desired flow. By limiting the valve opening, and because of the faster response of position sensing, the invention will generally lead to a reduction in the tendency of the valve to overshoot.

A similar beneficial effect of the present invention is obtained when the direction of flow through a bidirectional valve is reversed.

Although the flow sensor will often be located close to the valve, some applications require that the flow sensor be located close to the load. In such a case, the flow feedback from each load will normally be through an electrical flow feedback signal. The greater separation of the flow sensor from the valve increases the likelihood of the electrical connection being broken. The position sensing means are mounted on the valve, and will usually form an integral part of the valve assembly, whereby there is less likelihood of interruption than with feedback from a remote flow sensor.

Figure 2:
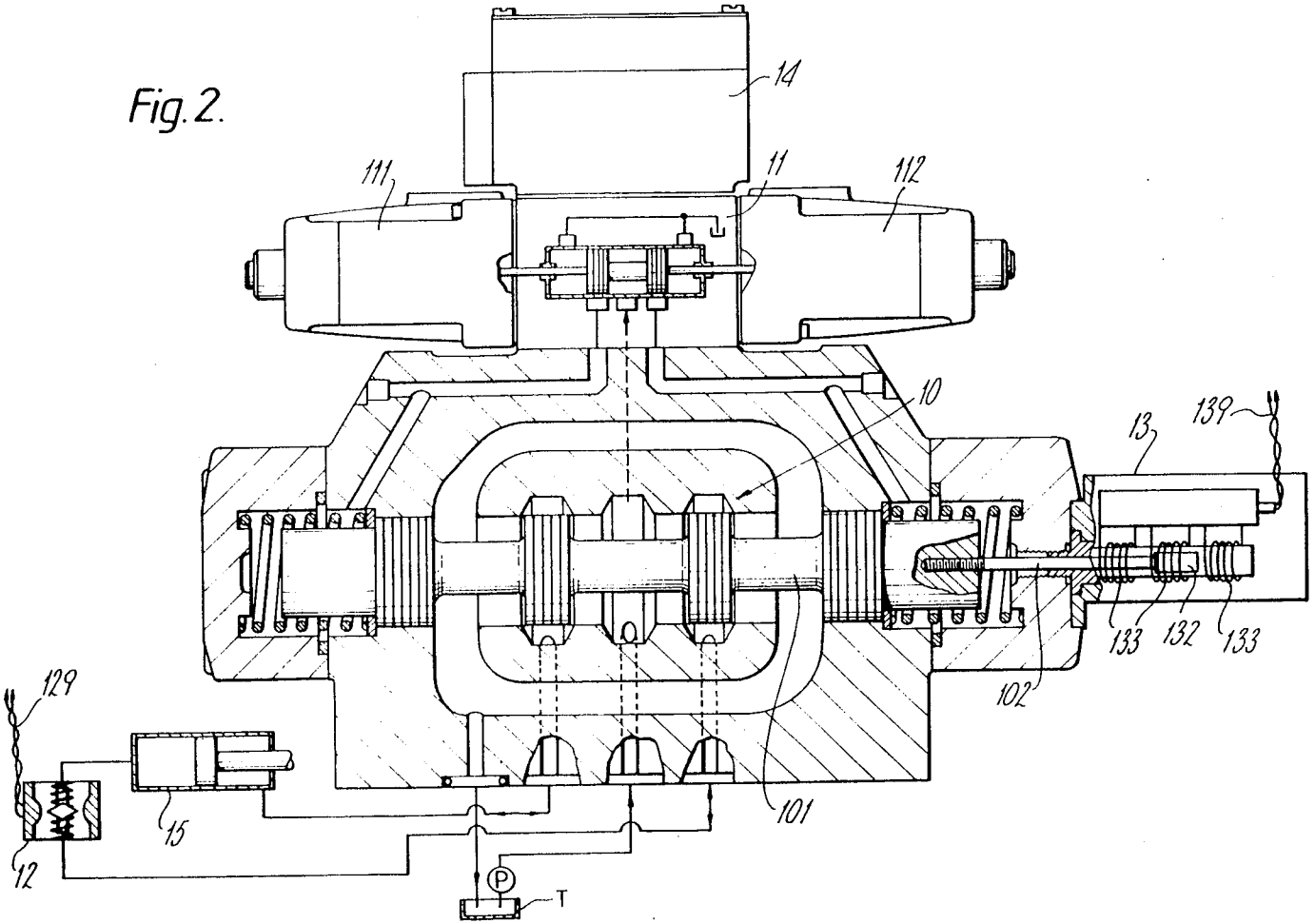

The invention will now be described in greater detail, by way of example, with reference to the accompanying drawings, in which:

FIG. 1 is a a block diagram of a valve arrangement incorporating the present invention, and FIG. 2 is a partly schematic longitudinal section through a hydraulic spool valve incorporating a spool position sensor.

Referring first to FIG. 1, there is shown a valve arrangement comprising a main valve 10, a pilot valve 11, a flow sensor 12, a position sensor 13 and electronic control circuitry 14. Flow Q through the main valve 10 is controlled by a signal q from the pilot valve 11. More precisely, the flow signal q is applied to an integrating stage 10A to determine the position X of the flow controlling member of the main valve, and the position X in turn determines the flow resistance 10B of, and hence the flow Q through, the valve 10. The pilot valve 11 receives from the circuit 14 an input current I which determines the pilot valve setting. The Flow Q from the main valve 10 to the load, such as an actuator 15, is measured by the flow sensor 12 whose output signal $S_Q$ on line 129 is proportional to the flow Q. The position X of the flow-controlling valve member within the main valve 10 is sensed by the position sensor 13 whose output signal $S_X$ on line 139 is proportional to the displacement of the valve member such as, for instance the main valve spool 101 in FIG. 2. The electronic circuit 14 has an input receiving an electrical demand signal $S_D$ proportional to the desired flow. The demand signal $S_D$ is applied to one input of each of two summing junctions 141 and 142 whose second inputs are respectively connected, via optional gain control circuits 146 and 147, to the output lines 129 of the flow sensor 12 and 139 of the position sensor 13. The respective output signals $S_A$ and $S_B$ of the summing junctions 141 and 142 are supplied as inputs to a compare and select circuit 143. The output signal $S_E$ of the circuit 143 is supplied to a power amplifier circuit 144 which supplies an input current I, proportional to the signal $S_E$, to the pilot valve 11.

Referring now to FIG. 2, there is shown a pilot-operated spool valve 101 arranged to control the magnitude and direction of the flow to and from the load 15, the valve member controlling the flow Q being the main valve spool 101. For a detailed description of the construction and operation of a commercially available, pilot-operated flow feedback controlled hydraulic spool valve, reference is made, for example, to the aforementioned British Patent Specification No. 1,335,042.

The spool position sensor 13 is mounted on the valve 10 adjoining one end of the main spool 101. A rod 102 provides a rigid link between the end of the spool 101 and a movable core 132 of the position sensor 13. The position sensor 13 is a commercially produced linear variable displacement transducer (LVDT) available for example, from Elektroteile GmBH, Uhldingen Muhlhofen, Federal Republic of Germany.

Referring now to FIGS. 1 and 2, and assuming for the moment that the load resistance bearing on the actuator 15 is less than a predetermined maximum, the operation of the illustrated valve arrangement is as follows. The desired flow Q to the actuator 15 is determined by the demand signal $S_D$, assumed for the purposes of explanation to be positive, on line 140. In the steady state, i.e. when the actual flow Q equals the desired flow, the flow feedback signal $S_Q$ is equal in magnitude but opposite in polarity to the demand signal $S_D$. Consequently, the sum signal $S_A$, and hence the error signal $S_E$ applied to the input of the amplifier 144, are practically zero. The position feedback signal $S_X$, also of negative polarity, on line 139 is arranged by adjustment of the gain and bias control circuits 146 and 147, or the like, to be equal to the flow feedback signal $S_Q$ only at a valve opening corresponding to a maximum permissible load. Remembering that the smaller the load resistance, the less the valve needs to be open for a given flow, the signal $S_X$ will be seen, under the assumed conditions to be less negative than the signal $S_Q$, making the signal $S_B$ greater than zero. Indeed, under normal operating conditions and with normal loads, the signal $S_B$ will be appreciably greater than zero. The circuit 143 is a compareand select circuit which compares the sum signals $S_A$ and $S_B$, and supplies whichever is the smaller as the error signal $S_E$ to the amplifier 144. Since the signal $S_D$ is coupled to both summing junctions 141 and 142, a change in the demand signal will not affect the relative magnitudes of the signals $S_A$ and $S_B$. Variations in the load resistance lead to a variation of the sensed flow, and hence in a change in the sum signal $S_A$. However, provided the gain and bias control circuits 146 and 147 are suitably adjusted, the signal $S_A$ will, under normal operating conditions, always remain smaller than the signal $S_B$, although their relative magnitudes will be affected. For example, a minor increase in the load resistance will result in a reduction of the flow Q. This leads to a less negative flow feedback signal $S_Q$, and therefore when added to the demand signal $S_D$, to a slightly positive sum signal $S_A$. This sum signal is then passed by the circuit 143 as the error signal $S_E$ to the amplifier 144, and the output current I will operate the pilot valve to cause an increase in the valve opening 10A by shifting the valve member further from its rest position, thereby causing the position signal $S_X$ to become more negative so that the difference between $S_A$ and $S_B$ is narrowed. However, if the gain circuits 146 and 147 are properly adjusted, the position signal $S_X$ will still be less negative than the flow signals $S_Q$, and hence the sum signal $S_B$ will remain positive, while the flow signal $S_A$ will return from its smaller position value to zero as soon as the correct flow has been re-established.

Assuming now that malfunction of the flow sensor 12 occurs, for example a failure of its return spring. Such a failure causes the flow sensor 12 to open further, thereby reducing the pressure drop across its orifice. The signal $S_Q$ which corresponds to the pressure drop now becomes less negative, so that the signal $S_A$ becomes positive, leading to a further opening of the valve. Further opening of the valve produces an increasingly negative signal $S_X$ and hence a decreasing signal $S_B$. At the point where the signal $S_A$ becomes larger than the signal $S_B$, the circuit 143 switches over to pass the signal $S_B$ as the error signal $S_E$. At that point the valve opening corresponds to a maximum permissible load resistance, and the main valve 10 is prevented from opening any further, until there is a change in the demand signal $S_D$.

It will be readily understood from the foregoing explanation that the compare and select circuit 143 will temporarily select the position feedback signal $S_X$ as the appropriate feedback signal under saturation conditions, that is if a desired flow to the load has been set but due to the large load resistance the load has not yet begun to move. The position feedback will maintain the valve at an opening less than full until movement of the load commences. Movement of the load, of course, implies flow of fluid to the load and a reduction in the apparent load resistance. As soon as the load resistance drops below the predetermined maximum value, the circuit 143 restores control to the flow feedback loop. Moreover, since the valve opening is closer to the correct value, less time is needed to reach the correct opening.

Similarly, on a sudden upward change of the demand signal $S_D$, the position sensor 13 will permit a shift of the flow control element of the valve 10 only to a position corresponding to the maximum load, and this shift will normally be less than would result if only the flow feedback mechanism were employed, since the flow feedback mechanism is generally slower than the position feedback. The tendency to overshoot is thereby reduced.

It will be seen that in normal operation of the valve, the flow feedback signal $S_Q$ is dominant and it is only in the event of a fault occurring in the flow sensor 12 that the back-up provided by the position sensor 13 takes over. Of course, if the position sensor 13 were to develop a fault, then the flow feedback signal would merely continue to dominate so that normal operation would not be impaired.

The flow sensor may be of any type other than the LVDT type illustrated, for example a pressure transducer, and the invention is equally applicable to a two-way valve as well as the four-way valve illustrated in FIG. 2.

I claim:

1. A valve arrangement comprising a pilot operated hydraulic spool valve, means for sensing the position of the spool of the valve and producing an electrical flow feedback signal, means for producing an electrical position feedback signal, and means for summing the flow feedback signal and the position feedback signal with an electrical flow demand signal, and means for comparing the two summed signals and selecting one of the summed signals as a final demand signal for the valve, the comparing and selecting means being operable normally to apply said flow feedback signal as a control signal for the valve, and operable to apply said position feedback signal as a control signal for the valve if the flow feedback signal indicates less than a predetermined mimimum flow for a given valve opening.

2. The valve arrangement set forth in claim 1 wherein said comparing means includes means for comparing said flow feedback signal and a demand signal to produce a flow feedback error signal, means for comparing said position signal and said demand signal to produce a position feedback error signal, and means for receiving both said flow error signal and said position error signal and operable to pass only the lower of the two signals as a control signal to the pilot valve such that normally the flow error signal is used to control the pilot valve but the position error signal is substituted therefor if the flow error signal rises above the position error signal.

3. A valve according to claim 1, wherein the flow feedback signal and the position feedback signal are each passed through a variable gain device before being summed with the demand signal.

4. A valve arrangement comprising a main valve having a flow controlling valve member, an electrically operated pilot valve for controlling the main valve in response to a demand signal, integrating means connected between the pilot valve and the main valve and operable to convert pilot valve flow to displacement of the main valve flow controlling member, a flow sensor for sensing the flow from the main valve to a load and producing an integrated electrical flow feedback signal, first comparator means for comparing the demand signal with the flow feedback signal to produce a flow feedback error signal, a position sensor for sensing the position of the flow control valve member in the main valve and producing an integrated electrical position feedback signal, second comparator means for comparing the demand signal with the position feedback signal to produce a position feedback error signal, and select circuit means connected to receive both the flow error signal and the position error signal and operable to pass only the lower of the two signals as a control signal to the pilot valve, whereby normally the flow error signal is used to control the pilot valve but that the position error signal is substituted therefor if the flow error signal should rise above the position error signal.

5. The valve arrangement set forth in claim 4 wherein said main valve comprises a flow feedback controlled spool valve and said pilot valve comprises an electrically operated pilot valve.

6. The valve arrangement set forth in claim 5 wherein said flow feedback signals comprise electrical signals.

7. The valve arrangement set forth in claim 6 wherein said select circuit means comprises a compare and select circuit.

8. The valve arrangement set forth in claim 7 including variable gain means through which the flow feedback signal and position signal pass to said compare and select circuit.

* * * * *